US005941782A

United States Patent [19]

Cook

[11] Patent Number: 5,941,782

[45] Date of Patent: Aug. 24, 1999

[54] CAST GOLF CLUB HEAD WITH STRENGTHENING RIBS

[76] Inventor: Donald R. Cook, 2211 Centennial, Ann Arbor, Mich. 48103

[21] Appl. No.: 08/949,595

[22] Filed: Oct. 14, 1997

[51] Int. Cl.[6] ..... A63B 53/04

[52] U.S. Cl. ..... 473/346

[58] Field of Search ..... 473/324–350

[56] References Cited

U.S. PATENT DOCUMENTS

| | | | |
|---|---|---|---|
| 1,582,836 | 4/1926 | Link | 473/346 |
| 1,658,581 | 2/1928 | Tobia | 473/346 |
| 4,438,931 | 3/1984 | Motomiya | 473/346 |
| 4,681,321 | 7/1987 | Chen | 473/346 |
| 4,930,781 | 6/1990 | Allen | 473/346 |
| 5,000,454 | 3/1991 | Soda | 473/346 |
| 5,180,166 | 1/1993 | Schmidt | 473/346 |
| 5,292,129 | 3/1994 | Long | 473/346 |
| 5,295,689 | 3/1994 | Lundberg | 473/346 |
| 5,547,427 | 8/1996 | Rigal | 473/346 |

*Primary Examiner*—Sebastiano Passaniti
*Attorney, Agent, or Firm*—Young & Basile, PC

[57] ABSTRACT

A golf club head includes a shell formed of a front striking face, sole, opposed sidewalls and a rearwall defining an interior cavity. At least one rib projects between at least two of the front striking face, the rearwall, the opposed sidewalls, and the sole. A plurality of ribs may be disposed within the interior cavity. The plurality of ribs may extend laterally between the opposed sidewalls or between the front striking face and the rearwall. The ribs may also be disposed within an interior cavity formed by a completely closed, one piece shell forming the golf club head. The ribs are integrally cast with the shell.

10 Claims, 2 Drawing Sheets

CAST GOLF CLUB HEAD WITH STRENGTHENING RIBS

BACKGROUND OF THE INVENTION

1. Field of the Invention

The present invention relates, in general, to golf clubs and, more specifically, to metal golf club heads.

Golf clubs are generally of three different types, namely, drivers, irons and putters. In the past, drivers had heads made of wood which resulted in referring to these clubs simply as "woods." Since wood has a generally shorter useful life, particularly when used as a golf club head, then other stronger materials, such as metal, so-called "metal woods" have become prevalent in golf.

Metal golf club heads are typically cast as a thin, hollow shell. Generally investment casting or lost wax casting processes are employed. A number of golf club heads have been devised where a substantial portion of the thin shell is of one piece and an insert, such as a sole plate, face plate or weight, is mounted over an opening formed in the shell during the casting process to completely close the opening in the shell.

In certain club head designs, the hollow shell is filled with a foam or other plastic material. In one specific construction, the shell is formed as an open top receptacle having a front striking face, an opposed rear wall, opposed sidewalls that extend between the rearwall and the front striking face, and a bottom wall or sole. A plastic insert is molded or inserted into the cavity formed between the sidewalls, the rearwall, the front striking face, and the sole forms the top portion of the club head. However, it has been found that the plastic insert frequently decouples from the shell of the club head.

Thus, it would be desirable to provide a metal golf club head which has increased strength and rigidity over previously devised metal golf club heads. It would be desirable to provide a metal golf club head with increased strength which can be easily cast as a one piece structure.

SUMMARY OF THE INVENTION

The present invention is a metal golf club head having improved strength characteristics as compared to previously devised metal golf club heads.

In a preferred embodiment, the golf club head includes a shell having a front striking face, a bottom wall or sole, and opposed sidewalls extending from the front striking face to a rearwall which define an interior cavity. A support means extends within the interior cavity for supporting the shell. The support means includes at least one rib joined to at least one portion of the shell, such as one of the front striking face, the sidewalls, the sole and the rearwall, and extends away from at least one other of the front striking face, the sole, the sidewalls, and the rearwall.

In one embodiment, the at least one rib comprises one rib extending from the sole between one portion of the shell and, optionally, another portion of the shell. The one rib can extend between the sole and the front striking surface or between the front striking face and the rearwall. In this example, the one rib has a first end joined to the front striking face and an opposed second end joined to the rearwall. The first end of the rib extends higher from the sole than the second end of the rib. Alternately, the one rib can extend between the opposed the sidewalls, from the front wall to a sidewall, or from one sidewall to the rearwall in any configuration, angular orientation, thickness or cross-sectional shape. The one rib can also extend from only one portion of the shell, such as from the front striking surface, one of the sidewalls or the rearwall, to the sole without being joined to another portion of the shell.

In another embodiment, the at least one rib comprises two or more ribs, arranged in any angular orientation, and having any cross-sectional shape, and connections to the front striking face, the sidewalls, the rearwall and the sole of the shell. In one example, at least two ribs extend between the front striking face and the rearwall. The two ribs are preferably disposed in parallel to each other and spaced equidistantly about the lateral center point of the front striking face or the sweet spot of the front striking face of the entire golf club head. Alternately, the two ribs can be non-parallel and joined to different portions of the front striking face, the sidewalls and the rearwall of the shell.

In yet another embodiment, the at least one rib extends between the opposed sidewalls. The at least one rib may include first and second ribs, both co-planarily disposed and extending from a first end joined to one sidewall to a second end. The second ends are spaced apart. Alternately, the first and second ribs extending between the opposed sidewalls can be joined into a single elongated rib extending at any angle between the opposed sidewalls.

Depending upon the desired characteristics of the club head, a plurality of ribs may be formed within the interior cavity of the shell in any orientation, angular spacing and shape. For example, a plurality of ribs may extend from the sole radially inward from the front striking face, the sidewalls, and the rearwall. Such ribs may be individual ribs or opposed, co-planar ribs joined together into one or more elongated ribs extending between opposed surfaces of the shell, such as between the front striking face and the rearwall, between the opposed sidewalls, between the front striking face and one of the sidewalls, or between the rearwall and one sidewall.

In all embodiments, the at least one or more ribs are preferably integrally formed as a unitary cast portion of the entire shell. Further, the ribs may be provided in any number and in any orientation in the shell. The ribs may also project only from the sole of the shell and not be joined to any of the sidewalls, the front striking face or the rearwall.

In one specific embodiment, the shell has an open, cup-like shape with an interior cavity in which the at least one or more ribs is disposed. A plastic insert is molded or disposed in the cavity and forms the top wall or surface of the club head. In this specific embodiment, the at least one or more ribs serves the dual function of providing a secure support for the plastic insert to prevent separation of the plastic insert from the surrounding shell and, further, provides increased strength to the club face and/or to the entire club head.

The increased strength features provided by the ribs of the present invention are achieved without a significant increase in the cost of the club head or significantly increased material costs. Additional assembly is not required since the ribs can be preferably integrally cast as a unitary part of the shell.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
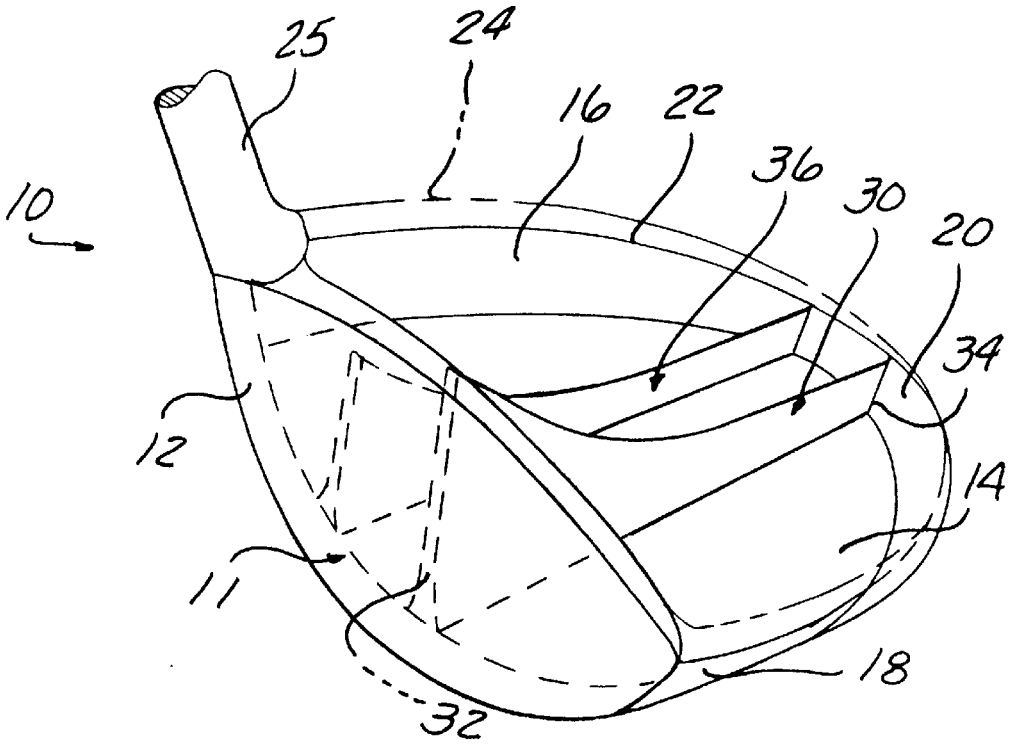
FIG. 1 is a perspective view of a golf club head with strengthening ribs constructed in accordance with one embodiment of the present invention.

Referring now to the drawing, and to FIG. 1 in particular, there is depicted a first embodiment of a golf club head 10 constructed in accordance with the teachings of the present invention. The golf club head 10 is formed with a conventional front striking face 12, a sole or bottom wall 14, opposed sidewalls 16 and 18, and a rearwall 20 spaced from the front striking face 12. The sidewalls 16 and 18, the front striking face 12 and the rearwall 20 are integrally joined as a one piece peripheral wall and project from the generally planar sole 14.

In this embodiment, the club head 10 is preferably cast as a shell 11 having a generally concave shape formed by the front striking face 12, the opposed sidewalls 16 and 18, and the rearwall 20 which terminate in a generally continuous upper or top edge 22. A plastic insert 24, shown in phantom in FIG. 1 is molded or inserted into the interior cavity within the shell 11. The plastic insert 24 forms the top wall or surface of the club head 10. A hosel 25 extends from one edge juncture of the front striking face 12 and one sidewall 16.

The above-described club head 10 is by example only. Other configurations for the club head 10 may also be used with the features of the present invention. For example, the front striking face 12 may be formed by a peripheral edge surrounding an interior opening communicating with the interior cavity within the shell 11. A separate striking plate, not shown, can be fixedly joined to the peripheral edge to form the front striking face 12 of the club head 10.

As is conventional, the front striking face 12, regardless of its construction, is generally higher in the middle and tapers in a generally arcuate or smoothly curved manner to the sidewalls 16 and 18. Similarly, the top edge 22 tapers gradually and smoothly from the front striking face 12 to the rearwall 20 such that the rearwall 20 is generally shorter in height, as measured from the sole 14, than the front striking face 12. Sidewalls 16 and 18 also taper smoothly from the outer edges of the front striking face 12 to the rearwall 20 which generally has a shorter lateral width than the width of the front striking face 12.

According to the present invention, a support means 30 is disposed within the hollow interior cavity within the shell 11. The support means 30 supports the shell and increases the strength and/or rigidity of the shell or at least selected portions of the shell, such as the front striking face, etc. By example only, the support means 30 is formed of at least one rib, also depicted by reference number 30. The rib 30 has a thin cross-section; but, maybe formed of other shapes and cross-sections to provide desired strength and other performance characteristics to the club head.

The purpose of the support means or rib 30 is to increase the strength and/or rigidity of the front striking face 12 or of the entire club head 10. The at least one rib 30 also provides a surface for securing the plastic insert 24 within the club head 10 and to prevent separation of the insert 24 from the club head 10.

Further, in the embodiment shown in FIG. 1, as well as all of the other embodiments of the present invention described hereafter, the at least one rib 30 may be fixedly joined to the club head 10 by any suitable means, including by welding, mechanical fasteners, etc. However, it is preferred that the at least one rib 30 be integrally cast as a one piece, unitary part of the club head 10 during casting of the shell 11.

Various embodiments of the at least one rib 30 will now be described. As shown in FIG. 1, the at least one rib 30 comprises a single rib 30 having a first edge 32 joined to the rear surface of the front striking face 12 or to the top and bottom edges in a configuration where a peripheral edge surrounds an opening receiving a separate striking plate. The rib 30 also has an opposed second end 34 joined to the interior surface of the rearwall 20. Since the top surface of the club head 10 is generally higher at the front striking face 12 than at the rearwall 20, the rib 30 tapers or smoothly curves from a higher height at the first end 32 to a lower height at the second end 34.

The first end 32 of the one rib 30 may be disposed at any lateral position across the front striking face 12. Preferably, however, the one rib 30 is located at the center line of the front striking face 12 or centered within the sweet spot on the front striking face 12.

Alternately, the one rib 30 may comprise two, co-planarily aligned, short ribs, with one rib joined to the front striking face 12 and the second rib joined to the rearwall 20. The one rib 30 may also be disposed at any other location within the interior cavity of the shell 11 and joined to any one or two of the front striking face 12, the sidewalls 16 and 18 and the rearwall 20.

Figure 3:
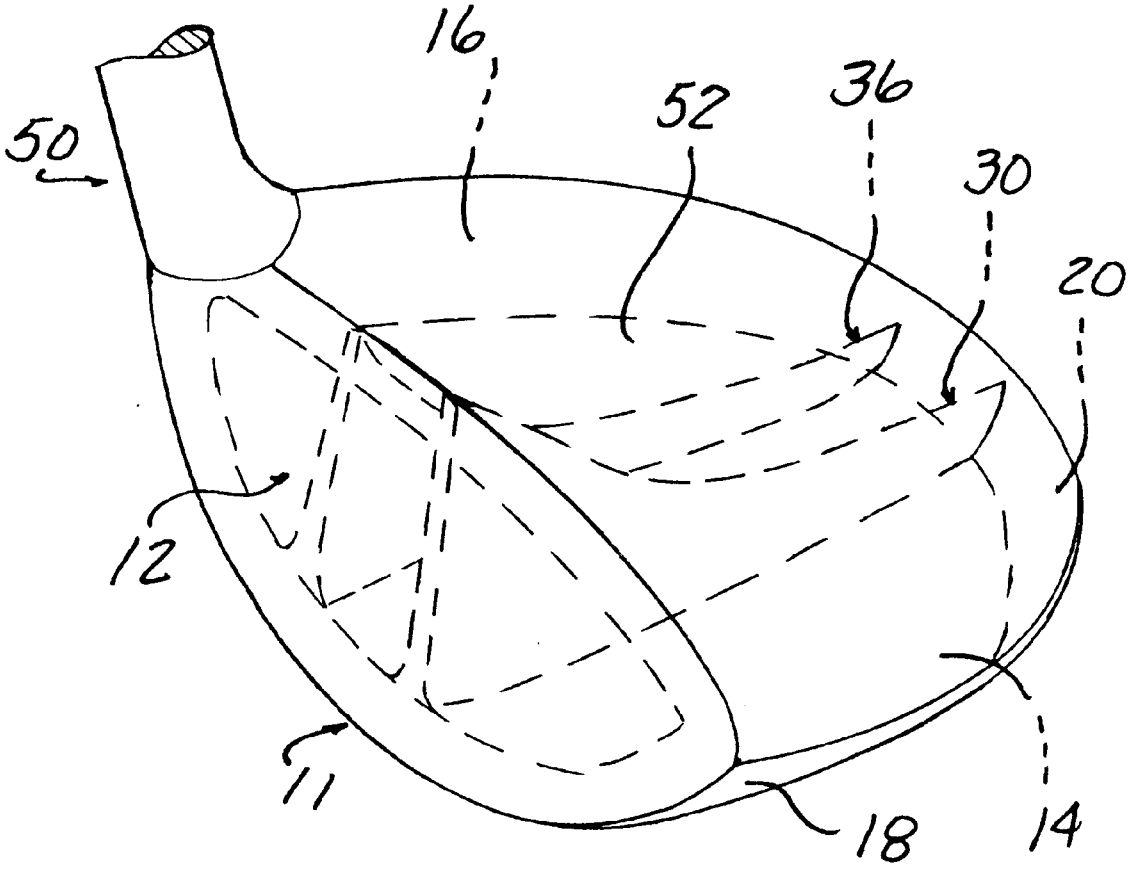
FIG. 3 is a perspective view of yet another embodiment of a golf club head with strengthening ribs according to the present invention.

In another embodiment, shown in FIGS. 1 and 3, the at least one rib comprises a plurality of individual, discrete ribs, with a pair of ribs, such as first and second ribs 30 and 36, being shown by way of example only. The first and second ribs 30 and 36 which are substantially identically constructed except that the second rib 36 may be the same shape, but slightly smaller in height at the first end 32 than the first rib 30. In this embodiment, the first and second ribs 30 and 36 are spaced apart and extend generally in parallel to each other from the front striking face 12 to the rearwall 20. Further, the first and second ribs 30 and 36 are preferably spaced equidistantly about a lateral center of the front striking face 12 or equidistantly about the center of the sweet spot on the front striking face 12. Alternately, the first and second ribs 30 and 36 may be disposed in a non-parallel arrangement while still being respectively joined between the front striking face 12 and the rearwall 20 or between the front striking face 12 and one of the sidewalls 16 and 18 or between the rearwall 20 and one of the sidewall 16 and 18.

Figure 2:
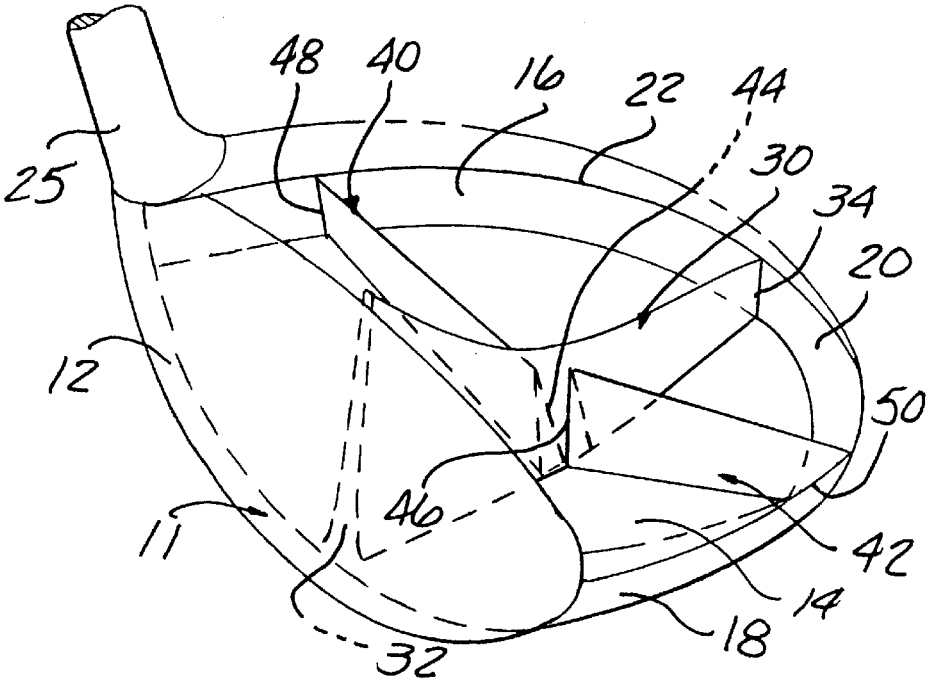
FIG. 2 is a perspective view of a second embodiment of a golf club head with strengthening ribs.

Another embodiment of the ribs is shown in FIG. 2 where the club head 10 has the same construction as that depicted in FIG. 1. In this embodiment, the at least one rib comprises one or a pair of first and second lateral ribs 40 and 42 which extend laterally between the opposed sidewalls 16 and 18. Although the ribs 40 and 42 can be integrally joined as a single elongated rib, the first and second ribs 40 and 42 are shown as being co-planarily aligned and spaced apart at second ends 44 and 46, respectively, by example only.

Each of the ribs 40 and 42 has a higher second end 44 and 46, respectively, than the opposed first ends 48 and 50 which are contiguous with or disposed in registry with the sidewalls 16 and 18, respectively.

The two above-described embodiments can be combined, as shown in FIG. 2, to include the first and second lateral ribs 40 and 42 and a single rib 30 extending between the front striking face 12 and the rearwall 20. The one rib 30 extends between the spaced second ends 44 and 46 of the first and second lateral ribs 40 and 42. The second ends 44 and 46 of the first and second lateral ribs 40 and 42 may be spaced from an intermediate portion of the rib 34 or integrally joined to the intermediate portion of the one rib 30. Alternately, any number of ribs arranged in any desired angular orientation and provided as discrete ribs extending radially inward from the front striking face 12, the sidewalls 16 and 18 and the rearwall 20 or joined to opposing ribs extending from an opposite portion of the shell may also be employed. Such a structure provides increased lateral and longitudinal rigidity and strength to the entire club head 10 as well as specifically strengthening the front striking face 12 and providing an enlarged interior surface for fixedly securing the plastic insert 24, shown in FIG. 1, within the shell of the club head 10.

Refer now to FIG. 3, there is depicted yet another embodiment of a club head 50 which incorporates all of the various rib structures described above and shown in FIGS. 1 and 2. In this embodiment, the club head 50 is formed of a one piece outer shell substantially completely surrounding a hollow interior cavity. The outer shell includes the front striking face 12, the opposed sidewalls 16 and 18, the bottom wall or sole 14, the rearwall 20, as well as a top wall 52. The at least one rib, which in FIG. 3 is depicted, by example, as being formed of the first and second ribs 30 and 36, is disposed within the interior cavity formed by the integrally joined or cast front striking face 12, sole 14, sidewalls 16 and 18, rearwall 20, and top wall 52. The rib structure may comprise the single rib 30 extending between the front striking face 12 and the rearwall 20, or the pair of ribs 30 and 36 extending between the front striking face 12 and the rearwall 20 by themselves or in combination with the pair of lateral first and second ribs 40 and 42. The lateral ribs 40 and 42 may also be employed strictly by themselves without any of the longitudinally extending ribs 30 or 36. It should be noted that a combination of the longitudinal ribs 30 and 36 with the first and second lateral ribs 40 and 42 can have the first lateral rib 40 in rigid contact with the sidewall 16 and the rib 36; while second lateral rib fixedly extends between the sidewall 18 and the rib 30.

All of the embodiments of the rib structure of the present invention may be simply formed as an integral part of the club head during the casting process by simply forming grooves in the mold core at the particular location and of the particular shape of the desired rib or ribs. Molten and metal poured into the mold cavity formed between the mold and the mold core will simultaneously form the ribs and the outer shell of the club head. This one piece molding process applies to the shell with the open cavity shown in FIGS. 1 and 2, as well as the closed one piece club head shown in FIG. 3.

The present invention by use of novel interiorly disposed ribs within a golf club head provides increased strength and rigidity to the entire golf club head as well as specifically to the front striking surface of the golf club. This increased strength and/or rigidity is achieved without additional labor and without a significant increase in material since the ribs can be integrally cast as part of the surrounding shell at the time of casting the shell.

What is claimed is:

1. A golf club head comprising:

a shell having a front striking face, a sole, and sidewalls extending from the front striking face to an opposed rearwall and a top wall defining an interior cavity; and at least one solid rib Joined to the front striking face and the sole and extending from the front striking face toward the rearwall, the at least one rib including:

a front portion contiguous with the front striking face and having an upper end and an outer edge extending from the upper end and diverging from the front striking face; and a bottom portion contiguous with the sole and extending angularly from the front portion toward the rear wall, the bottom portion having an outer edge extending from the outer edge of the front portion and converging toward the sole to an end.

2. The golf head of claim 1 wherein:

the shell is a cast shell; and the at least one rib is an integral cast part of the shell.

3. The golf club of claim 1 wherein:

the at least one rib has opposed first and second ends respectively joined to the front striking face and the rearwall.

4. The golf club head of claim 1 wherein:

the upper end has a higher height from the sole than a height of the end of the bottom portion of the rib.

5. The golf club head of claim 1 wherein the at least one rib comprises:

at least a pair of first and second ribs extending between the front striking face and the sole.

6. The golf club head of claim 5 wherein the pair of ribs are disposed substantially parallel to each other.

7. The golf club head of claim 5 wherein:

the pair of ribs are spaced substantially equidistantly about a lateral center of the front striking face.

8. The golf club head of claim 1 further comprising:

at least one lateral rib joined to the sole and extending between the opposed sidewalls.

9. The golf club head of claim 8 wherein the at least one lateral rib comprises:

first and second lateral ribs, each extending from a first end joined to one of the sidewalls to a second end.

10. The golf club head of claim 9 wherein:

the second ends of the first and second lateral ribs are spaced apart.

* * * * *